US006536707B2

(12) United States Patent
Adelakun

(10) Patent No.: US 6,536,707 B2
(45) Date of Patent: Mar. 25, 2003

(54) MOISTENED TISSUE DISPENSER WITH EJECTION MECHANISM AND PAPER ROLL PACKAGE FOR USE THEREIN

(76) Inventor: Olufemi Adelakun, 19640 NW. 82nd Ct., Hialeah, FL (US) 33015

( * ) Notice: Subject to any disclaimer, the term of this patent is extended or adjusted under 35 U.S.C. 154(b) by 23 days.

(21) Appl. No.: 09/798,018

(22) Filed: Mar. 1, 2001

(65) Prior Publication Data

US 2002/0096596 A1 Jul. 25, 2002

Related U.S. Application Data

(63) Continuation-in-part of application No. 09/767,445, filed on Jan. 23, 2001.

(51) Int. Cl.[7] ..... B65H 16/06; B65H 18/28; B65D 85/02; B65D 85/672; B32B 3/04

(52) U.S. Cl. ..... 242/598.6; 242/160.1; 242/178; 242/588.6; 242/598.3; 428/126; 428/906

(58) Field of Search ..... 242/588.6, 588.5, 242/598.3, 598.6, 599.3, 159, 160.1, 176, 178

(56) References Cited

U.S. PATENT DOCUMENTS

| | | | | | |
|---|---|---|---|---|---|
| 1,608,331 | A | * | 11/1926 | McElwain | 428/43 |
| 1,884,784 | A | * | 10/1932 | Marcalus | 428/43 |
| 2,033,621 | A | * | 3/1936 | Freedman | 428/43 |
| 2,553,923 | A | * | 5/1951 | Lambert | 428/43 |
| 2,823,444 | A | * | 2/1958 | Davies et al. | 428/43 |
| 3,729,145 | A | * | 4/1973 | Koo et al. | 242/55.53 |
| 4,089,481 | A | * | 5/1978 | Ciuci | 242/55.53 |
| 4,097,002 | A | * | 6/1978 | Krueger | 242/55.2 |
| 4,101,026 | A | * | 7/1978 | Bonk | 209/205 |
| 4,627,117 | A | * | 12/1986 | Morishita | 4/247 |
| 4,721,264 | A | * | 1/1988 | Muscarello | 242/55.53 |
| 4,950,511 | A | * | 8/1990 | Francis | 428/35 |
| 5,439,521 | A | * | 8/1995 | Rao | 118/415 |
| 5,598,987 | A | * | 2/1997 | Wachowicz | 242/597.8 |
| 5,660,313 | A | * | 8/1997 | Newbold | 225/42 |
| 5,680,978 | A | * | 10/1997 | Pinion | 225/106 |
| 5,697,577 | A | * | 12/1997 | Ogden | 242/598.6 |
| 5,704,566 | A | * | 1/1998 | Schultz et al. | 242/595 |
| 5,752,666 | A | * | 5/1998 | Simbaee | 242/160.4 |
| 5,765,717 | A | * | 6/1998 | Gottselig | 221/45 |
| 5,853,845 | A | * | 12/1998 | McConnell et al. | 428/126 |
| 5,897,074 | A | * | 4/1999 | Marino | 242/597.1 |
| 6,019,309 | A | * | 2/2000 | Entz | 242/588.5 |
| 6,056,235 | A | * | 5/2000 | Brozinsky | 242/598.6 |
| 6,098,836 | A | * | 8/2000 | Gottselig | 221/45 |
| 6,382,552 | B1 | * | 5/2002 | Paul et al. | 242/595 |

* cited by examiner

*Primary Examiner*—Donald P. Walsh
*Assistant Examiner*—Daniel K Schlak
(74) *Attorney, Agent, or Firm*—Robert M. Downey, P.A.

(57) ABSTRACT

A device for holding and dispensing moistened tissue from a roll includes a housing having a cylindrical wall, a fixed end wall and an opposite removable end wall to allow placement of the tissue roll on an integral tubular dowel in the housing. A hinged door moves between a normally closed, sealed position and an open position to facilitate removal of individual sheets of the moistened tissue through an access opening. Pegs extending outwardly from the opposite end walls are keyed to fit within congruently configured recesses of a holder for securing the housing to the holder without rotating. An ejection control urges one of the pegs inwardly against a spring to release the housing from the holder to facilitate refilling of tissue when needed. In one embodiment, the holder accommodates both a roll of dry tissue and a roll of moistened tissue. Sheets of paper packaged on the roll include a central panel and opposite side panels folded over a top side of the central panel for compactness and ease of grasping the edges of the side panels when detaching each sheet from the roll.

18 Claims, 16 Drawing Sheets

MOISTENED TISSUE DISPENSER WITH EJECTION MECHANISM AND PAPER ROLL PACKAGE FOR USE THEREIN

This application is a continuation-in-part application based on previously filed and co-pending patent application Ser. No. 09/767,445 filed on Jan. 23, 2001.

BACKGROUND OF THE INVENTION

1. Field of the Invention

The present invention is directed to a dispenser for pre-moistened wipes and, more particularly, to a dispensing device adapted to be mounted to an existing toilet paper roll holder for storing and selectively dispensing pre-moistened wipes from a roll.

2. Discussion of the Related Art

Virtually all bathrooms are fitted with a roll fixture which is specifically structured to rotatably support a roll of toilet paper thereon. The conventional roll of toilet paper is provided with a tubular core which is adapted to receive a spring loaded dowel axially therethrough so that opposite ends of the dowel are urged within opposing recesses of the toilet paper roll holder fixture. The fixture, with the roll of conventional toilet paper rotatably supported thereon, facilitates dispensing of select lengths of sheet paper from the roll, for hygienic purposes, particularly when using a commode.

Presently, there are numerous brands of pre-moistened towelettes or wipes which can be purchased in either a box dispenser or as individually wrapped units. For the most part, pre-moistened towelettes and wipes have been used for cleaning the hands, particularly after eating a meal at a restaurant or picnic, and as a means for cleaning a baby when changing a diaper. And, while use of pre-moistened towelettes or wipes is desirous for use in a bathroom, and particularly next to a commode, presently available pre-moistened wipes lack the convenience of a mounted roll dispenser. In particular, the packaging methods and containers for pre-moistened towelettes and wipes are not adapted for dispensing from a roll in a manner similar to a conventional toilet paper roll holder fixture of the type commonly found next to a commode in a bathroom. Instead, pre-moistened wipes presently on the market are packaged in a stacked array, usually within a rectangular shaped plastic bag or box which is not suited for convenient dispensing in a bathroom.

Others have proposed various dispenser devices for dispensing pre-moistened toilet paper from a wall mounted housing. Specifically, the U.S. patent to Ogden, U.S. Pat. No. 5,697,577 discloses a pre-moistened toilet paper dispenser having a housing with a chamber sized to receive a pre-moistened toilet paper roll on a cylindrical rod within the housing. The housing includes a side opening with a door which is slidably mounted to the housing to selectively cover the opening. By opening the door, the toilet paper positioned within the housing can be dispensed for use. The Ogden dispenser further includes a hollow compartment fixed to a bottom portion of the housing for containing electronics used for warming the moistened toilet paper. Other examples of pre-moistened toilet paper dispensers proposed in the art can be found in the U.S. patents to Rao, U.S. Pat. No. 5,439,521; Newbold, U.S. Pat. No. 5,660,313; Marino, U.S. Pat. No. 5,897,074; Brozinsky, U.S. Pat. No. 6,056,235; Douglas, U.S. Pat. No. 3,995,582; and Bloch, et al., U.S. Pat. No. 5,509,593.

While the various dispensers proposed in the related art all contemplate dispensing of pre-moistened toilet paper from a roll supported within an enclosed housing which may be mounted to a holder on a wall, they fail to fully address the needs of conveniently and effectively containing and selectively dispensing pre-moistened tissue in a bathroom setting. Specifically, the various devices proposed in the art fail to provide for easy and efficient removal of the housing from the holder in order to place a new roll of pre-moistened tissue in the housing when an existing roll has been depleted. The housings of the various devices proposed in the art, as described above, are all difficult to remove from the holder. Further, the proposed devices fail to provide means for maintaining an air tight seal enclosing the interior of the housing to thereby prevent premature drying of the moistened toilet tissue contained therein. Also, the proposed devices fail to provide adequate means to prevent rotation of the housing relative to the holder when removing tissue from the roll. Moreover, the various dispensing devices proposed in the related art fail to provide easily separable sheets of moistened toilet tissue mounted on a roll and folded in a manner which permits enlargement of individual detachable sheets once separated from the roll.

In view of the shortcomings in the related art, there remains an urgent need for a convenient and effective device for containing and dispensing pre-moistened wipes from a roll, wherein the device is specifically adapted for mounting to an existing toilet paper roll holder fixture in a bathroom.

SUMMARY OF THE INVENTION

The present invention is directed to a device for holding and dispensing moistened paper or tissue sheets from a roll. In particular, the moistened sheets may be for use by adults or children (infants and toddlers) for hygienic purposes. Moreover, the sheets may be of a type for use on hand wipes (wet towelettes) or napkins. The device includes a housing having a cylindrical wall and opposite end walls. At least one of the opposite end walls is removably attachable to an open end of the housing. The cylindrical wall, extending between the opposite end walls, includes an access opening with a hinged door which moves between an open position to facilitate removal of the moistened wipes from the roll, and a closed position. Seal means are provided to protectively encapsulate the roll within the housing in order to prevent drying of the wipes when the door is closed. A tubular dowel, integral with an inside face of one of the end walls, extends axially through an interior of the housing for rotatably supporting the roll of wipes thereon. Pegs extend outwardly from the opposite end walls are structured to fit within congruently configured recesses of a holder mounted to a wall or other structure in a bathroom, and preferably next to the commode. An ejection control is provided for urging one of the pegs inwardly against a spring maintained within the tubular dowel, to thereby release the peg from the insert so that the housing can be removed from the holder to replace empty tissue rolls. In a further embodiment, the holder is structured to accommodate both a roll of dry tissue and a roll of moistened tissue.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to the several views of the drawings, the moistened tissue dispenser of the present invention is shown and is generally indicated as 10. Specifically, the dispenser 10 includes a housing 12 which is adapted to be removably received within a holder 20 which secures and maintains the housing in an operative, fixed position.

Figure 3:
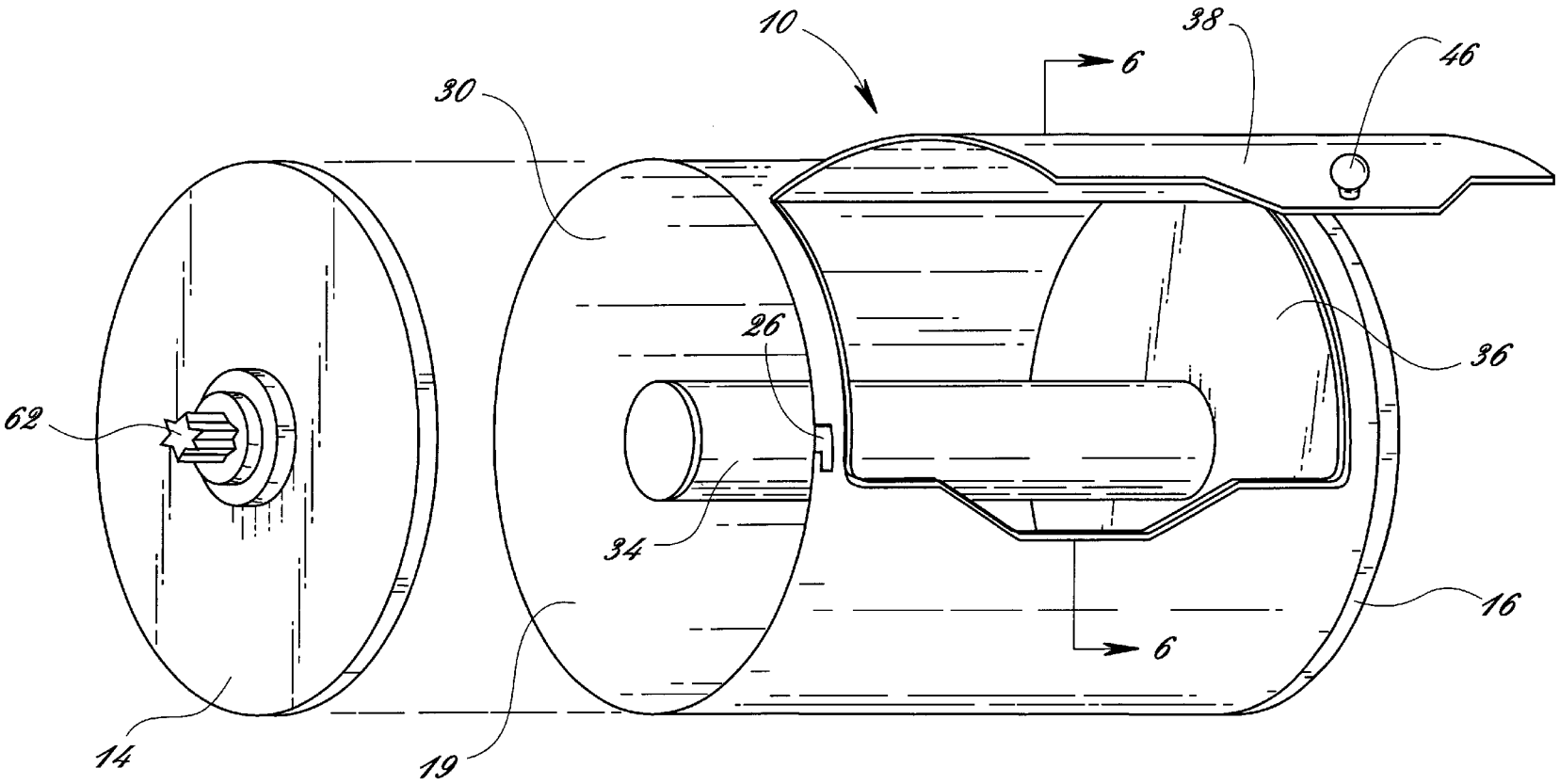
FIG. 3 is a partially exploded perspective view showing an end cover of the housing removed to facilitate replacement of a roll of pre-moistened tissue on a tubular dowel within the housing interior.
Figure 4:
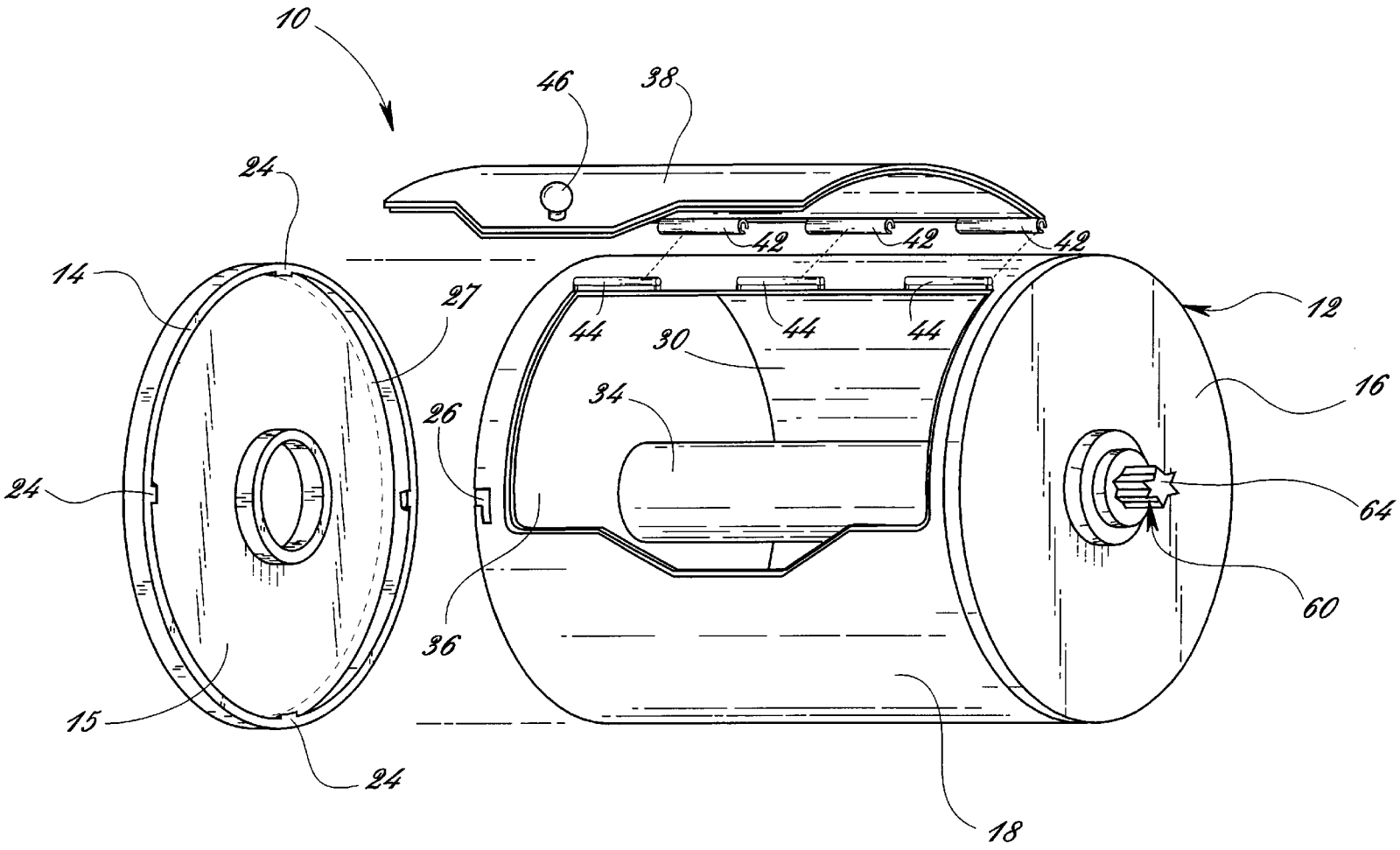
FIG. 4 is an exploded perspective view of the housing showing the end wall and door separated from the main housing.
Figure 8:
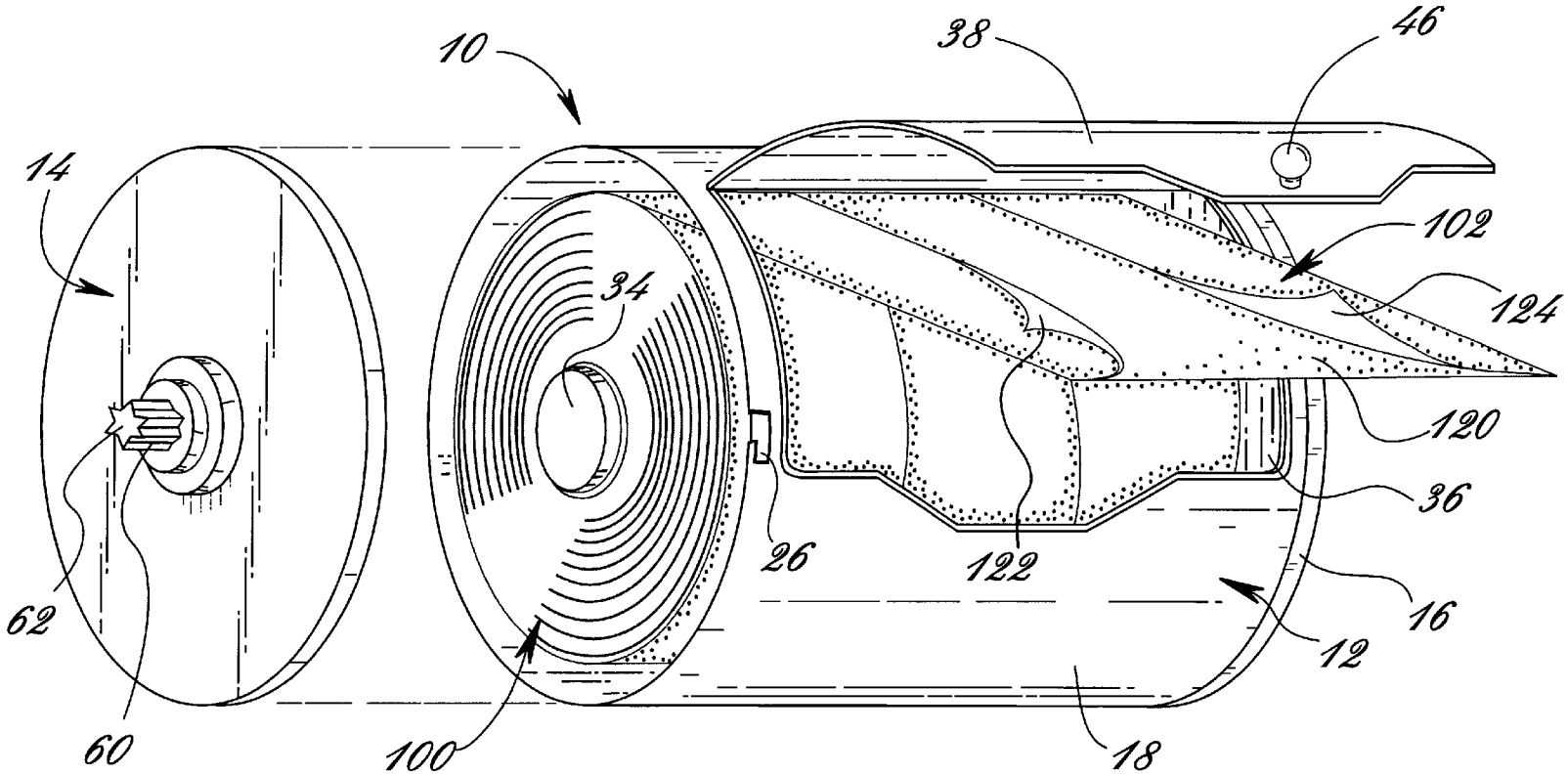
FIG. 8 is a partially exploded perspective view showing the end wall of the housing removed and a roll of moistened toilet tissue operatively positioned within an interior of the housing with a sheet of the roll extending outwardly through the opening of the housing for dispensing thereof while the door is in the open position.

The housing 12 includes a first end wall 14, an opposite end wall 16, and a generally cylindrical side wall 18 extending between the opposite end walls 14, 16. The first end wall 14, defining a cover, is preferably removable from the end of the cylindrical wall 18 to reveal an open end 19 of the housing, as shown in FIGS. 3, 4 and 8. In a preferred embodiment, the inner face 15 of the end wall 14 is provided with a plurality of spaced tabs 24, as best seen in FIG. 4, which interlock within corresponding slots 25 on the housing 12. Specifically, as illustrated in FIG. 3, the end wall 14 is attached to the housing by aligning the tabs 24 with the corresponding slots 26 and then moving the end wall 14 against the housing to cover the open end 19 so that each tab 24 is positioned within an open portion of the corresponding slot 26. Thereafter, slight clockwise rotation of the end wall 14 moves the tabs 24 into a locked position within a closed portion of the slots to hold the end wall 14 (i.e. cover) on the end of the housing 12. When the end wall 14 is attached to the housing, a ring seal 27 on the inner face 15 of the end wall 14 engages the annular edge 29 surrounding the open end 19 of the housing to provide an air tight seal. Alternatively, the end wall 14 may be removably attached to the open end 19 by thread means on the end wall 14 and the mating inner surface of the cylindrical wall 18 adjacent the open end or by frictional engagement means or a snap fit fastening arrangement.

Figure 1:
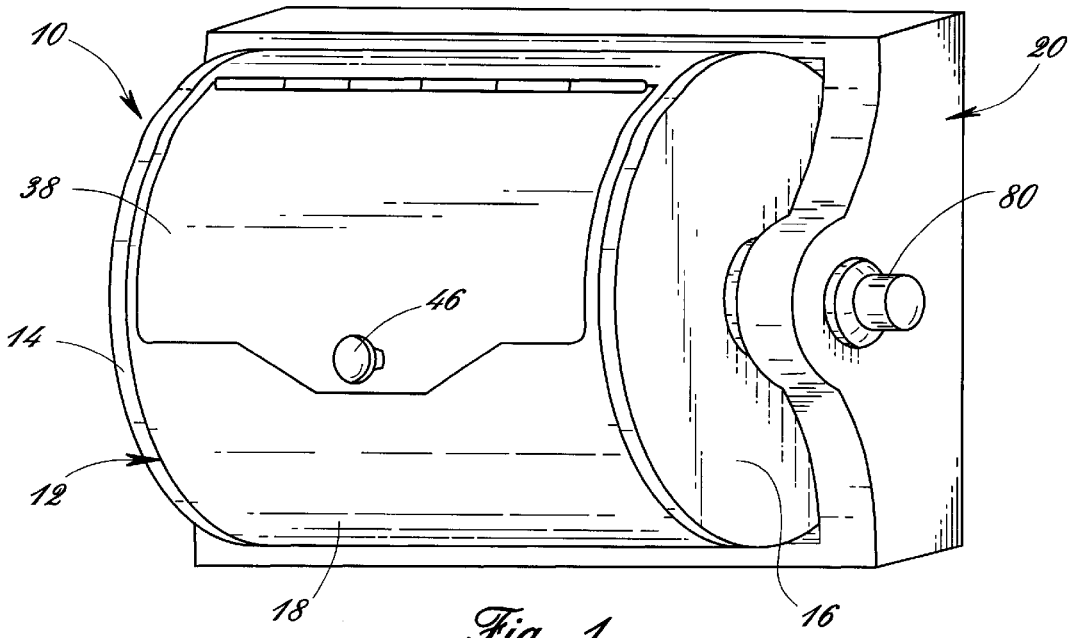
FIG. 1 is a perspective view of the dispenser housing shown supported within a wall mounted holder, in accordance with a preferred embodiment of the present invention.
Figure 5:
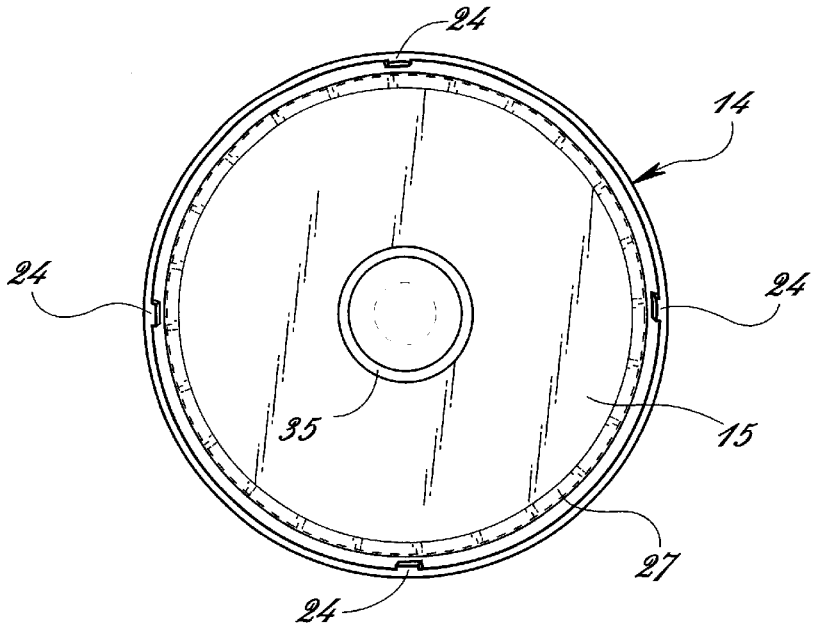
FIG. 5 is an elevational view of an inner facing side of the removable end wall of the housing, showing attachment tabs spaced about an annular rim and seal means for providing an air tight seal between the end wall and the housing cylindrical side wall.
Figure 6:
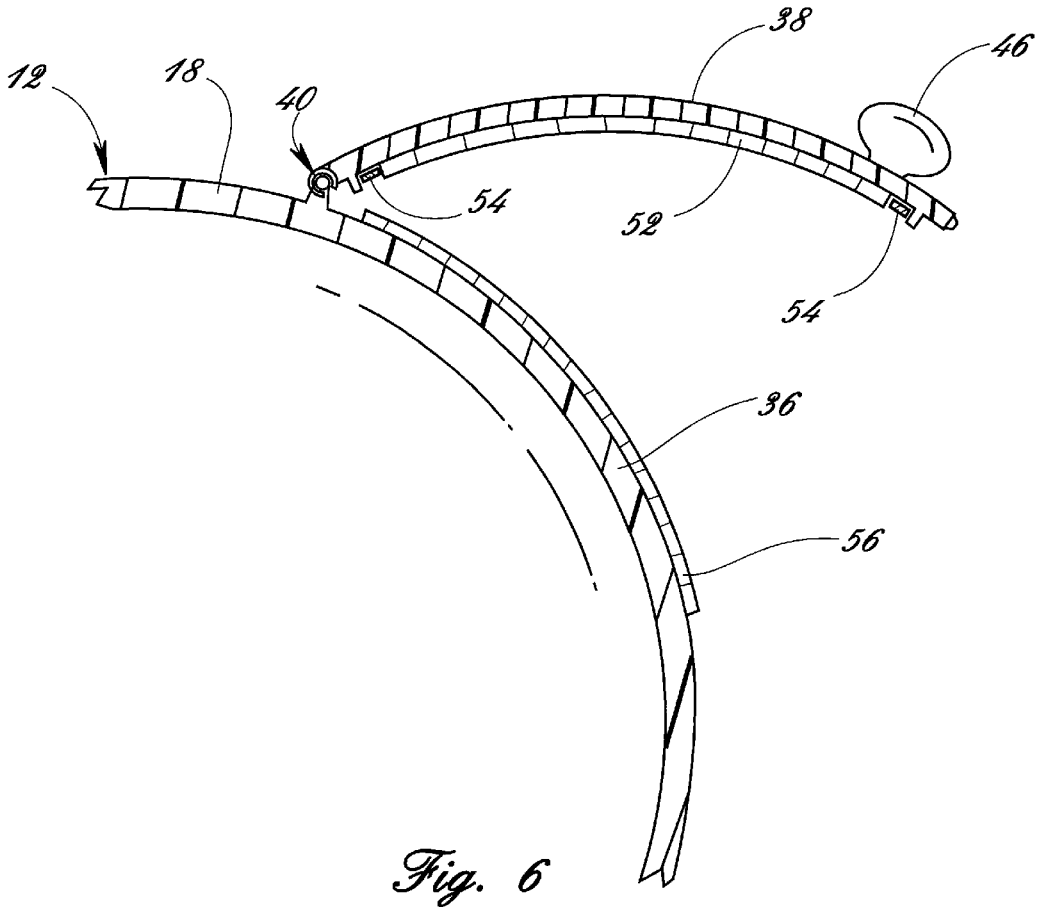
FIG. 6 is an isolated cross-sectional view taken along the plane of the line 6—6 in FIG. 3.

With the end wall 14 removed, a roll 100 of pre-moistened towelettes or tissue can be placed with an interior chamber 30 of the housing so that a tubular dowel 34 extending axially through the chamber is received through the center of the roll, thereby rotatably supporting the roll within the housing, as seen in FIG. 8. When the end wall 14 is attached, a ring 35 (see FIGS. 4 and 5) on the inner face 15 receives a distal end of the dowel 34, to thereby support the distal end and relieve stress on the opposite end of the dowel. A large front access opening 36 on the front of the cylindrical side wall facilitates access to the roll of pre-moistened tissue 100 to thereby enable dispensing of individual sheets 102 of the pre-moistened tissue outwardly through the opening 36 of the housing, as seen in FIG. 8. A door 38 is movable between an open position, to permit access to the roll of pre-moistened tissue 100 through the opening 36, and a closed, sealed position, wherein the roll of pre-moistened tissue is protectively contained within the interior chamber 30 to prevent premature drying thereof. In a preferred embodiment, the door 38 is hingedly attached to the side wall 18 of the housing along a top edge 39 of the door 38. Specifically, hinge means 40 are provided for permitting hinged movement of the door 38 between the closed position, as seen in FIG. 1, and the open position, as seen in FIGS. 3 and 8. The hinge means 40 is specifically structured to allow the door 38 to remain in the open position, at rest, so that the user can pull the individual sheets 102 of the pre-moistened tissue from the roll 100, outwardly through the opening 36 of the housing 12, as seen in FIG. 8. In a preferred embodiment, the hinge means 40 is defined by a plurality of partially open tubular segments or gudgeons 42 provided on the top edge 39 of the door 38 which align for snap fit, rotating attachment to corresponding bar segments 44 integrally molded with the housing and a second set of tubular segments or gudgeons 42' on an exterior of the side wall 18, just above the opening 36 in the housing. A handle or knob 46 is provided for lifting the door 38 to the open position.

Figure 7A:
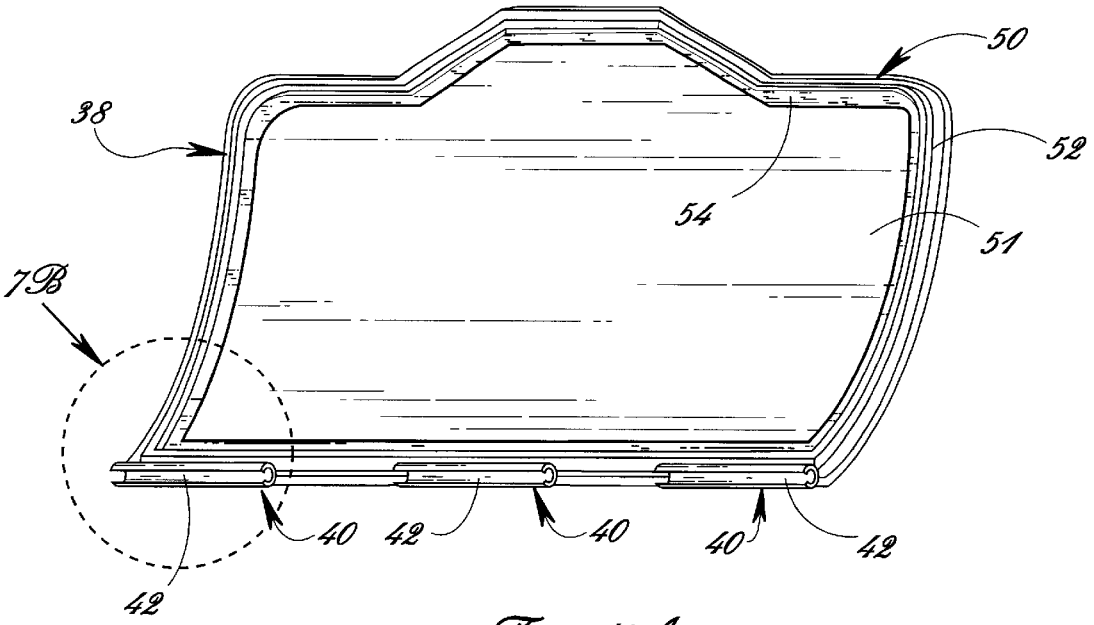
FIG. 7A is a perspective view of an under side of the door of the housing.
Figure 7B:
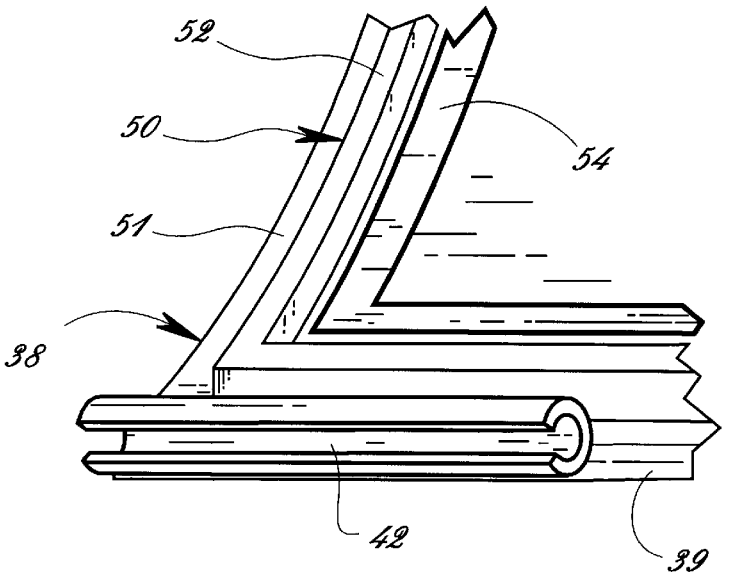
FIG. 7B is an isolated perspective view taken from the area indicated as 7B in FIG. 7A, showing a raised lip and resilient seal on an under side of the door of the housing.
Figure 7C:
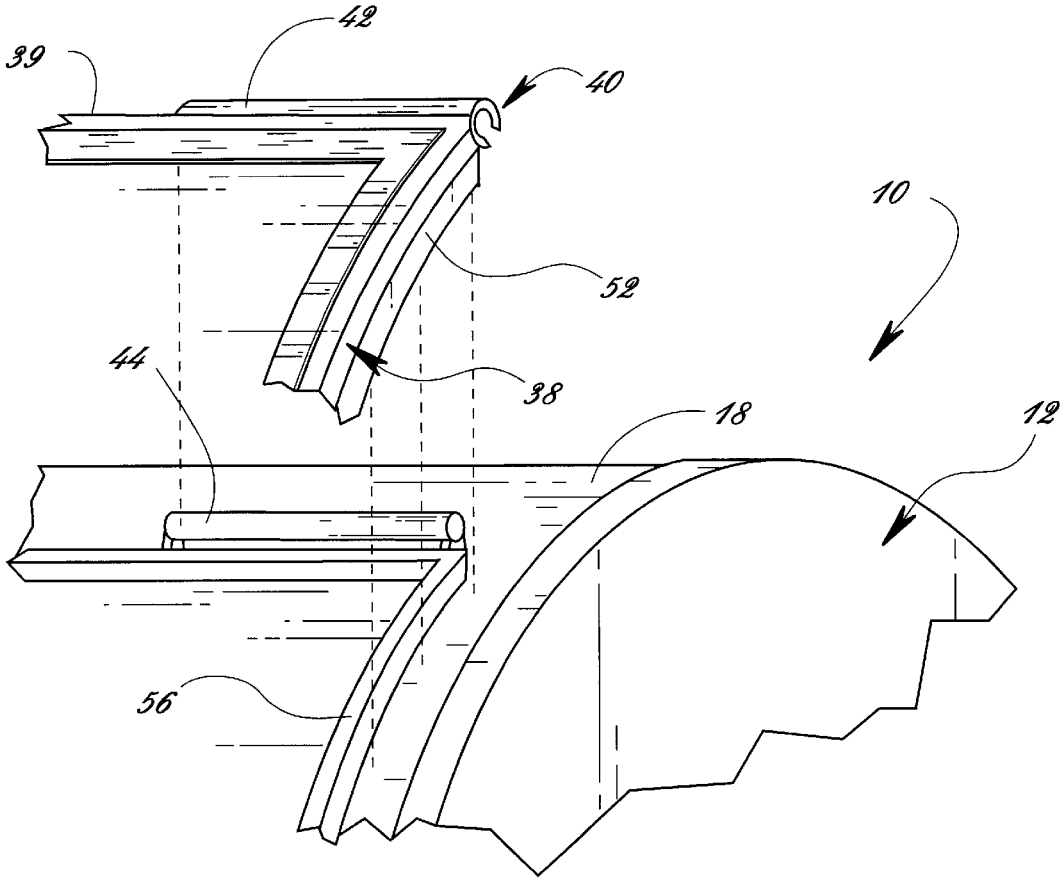
FIG. 7C is an isolated perspective view showing a portion of the housing and a portion of the door removed from the housing to illustrate the manner of attachment of the door to the housing and a cooperative positioning of the raised lip on the under side of the door with a raised lip surrounding the opening of the housing side wall for providing an air tight seal between the door and the housing when the door is in a closed position.

Referring to FIGS. 7A–7C, the door 38 is further provided with seal means 50 for maintaining an air tight seal between the door and the housing when the door is in the closed position. Specifically, the under side 51 of the door 38 is provided with a raised lip 52 which extends about the periphery of the door. A rubber seal 54 is fixed to the under side of the door, just adjacent to and just inboard of the raised lip 52, as best seen in FIG. 7B. The housing 12 is further provided with a raised lip 56 about the front access opening 36, as seen in FIG. 7C. The raised lip 56 on the housing is specifically structured and configured for cooperative positioning with the raised lip 52 on the under side of the door, so that the lip 56 on the housing is received inboard of the raised lip 52 on the under side of the door, when the door is in the enclosed position. Moreover, the raised lip 56 on the housing is structured and configured for sealing engagement with the rubber seal 54 on the under side of the door when the door in the closed position, thereby providing an air tight seal.

As seen in several of the drawing figures, the opposite end walls 14, 16 are provided with mounting means 60 for removably mounting the housing 12 within the holder 20. In a preferred embodiment, the mounting means 60 includes peg members 62, 64 which extend outwardly from the opposite end walls 14, 16 of the housing 12, in axial alignment with the tubular dowel 34 and the roll of moistened tissue 100 contained within the housing. The peg members 62, 64 are specifically sized and positioned for receipt within correspondingly aligned recesses 65, 66 in opposing walls 67, 68 of the holder, to thereby secure the housing in the fixed, operative position. In a preferred embodiment, the peg member 62 is integrally molded with the end wall 14 to provide a one-piece, unitary structure. The opposite peg member 64 is movable relative to the end wall 16 between an extended position, as shown in the drawings, and a compressed position, wherein the peg member 64 is pressed inwardly towards the interior chamber, and partially within the tubular dowel. Specifically, a spring 70 within the tubular dowel 34 urges a plunger 72 axially outward against the peg member 64, causing the peg member 64 to be pushed outwardly to a normally relaxed position, wherein the peg member 64 is fully extended from the end wall 16. Upon application of an inward, axial force on the peg member 64, the plunger 72 is caused to be pushed inwardly, causing the spring 70 to be compressed between the plunger 72 and the plug 74. Inward movement of the peg member 64 against the plunger 72 and spring 70 to the compressed position removes the peg member 64 from the recess 66, thereby allowing removal of the housing 12 from the holder 20.

In a preferred embodiment, the peg members 62, 64 are provided with a multi-angled outer surface configuration, such as a star-shape or square, to provide a keyed fit within a congruent configuration in the recesses 65, 66 of the holder 20. The multi-angled, keyed configuration of the peg members and associated recesses prevents rotation of the housing 12 relative to the holder 20 upon pulling the individual sheets 102 of tissue from the roll 100. More specifically, the roll of moistened tissue 100 is permitted to rotate about the tubular dowel 34 while the housing 12 remains stationary within the holder 20. FIGS. 11A–11E show various examples of multi-angled, keyed configurations of the peg members which are contemplated within the scope of the invention.

Figure 10:
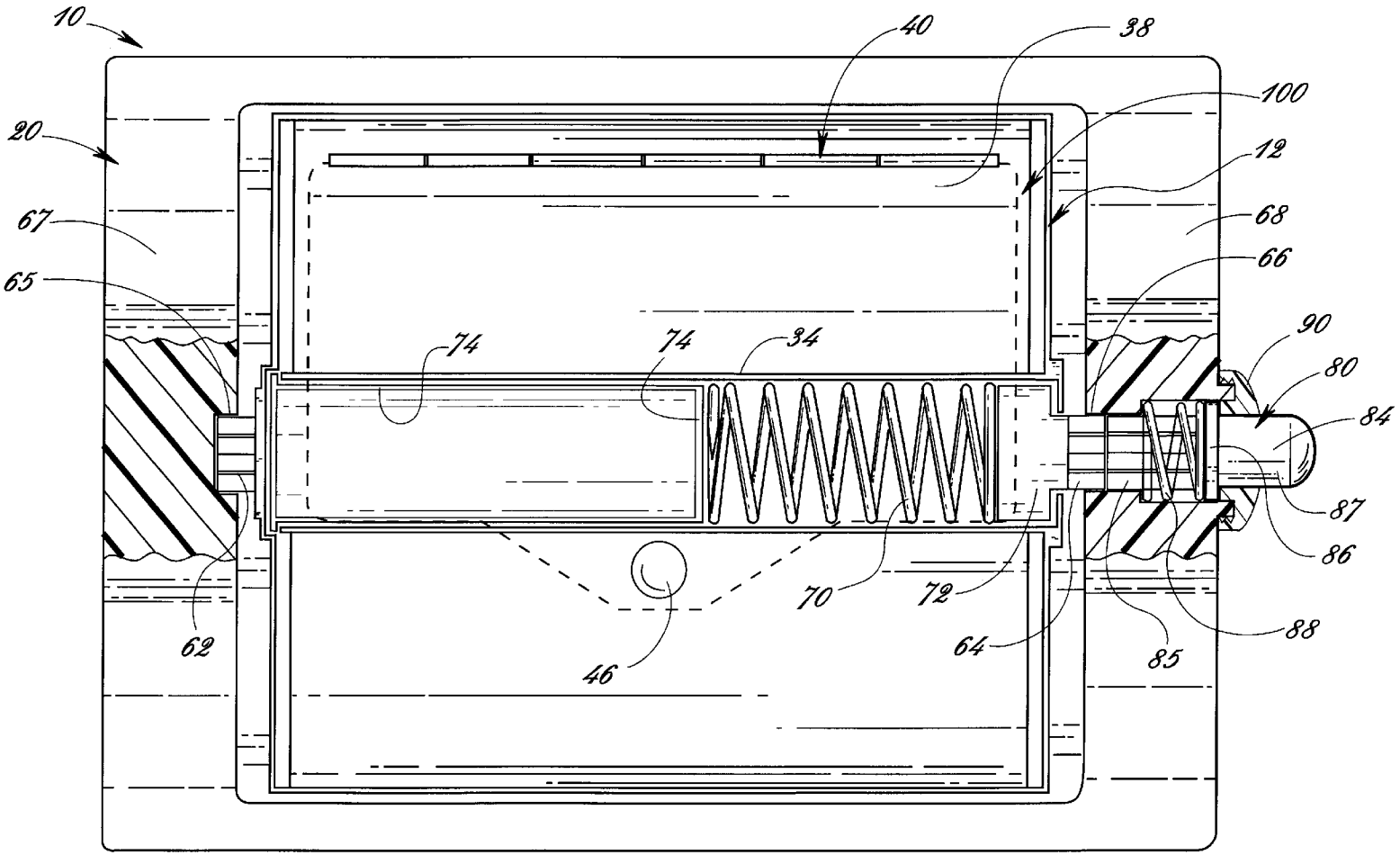
FIG. 10 is a front elevation, in partial cutaway, showing an ejection control mechanism on the holder for releasing the housing of the device from a mounted position within the holder in accordance with a preferred embodiment of the present invention.

In the preferred embodiment, as shown in FIG. 10, an ejection mechanism 80 is provided to permit easy removal of the housing 12 from the holder 20 when it is necessary to place a new roll 100 in the chamber 30. As seen in FIG. 10, the ejection mechanism 80 includes a button 84 captivated within a cavity 82 in axial, adjacent communication with the recess 66 in the side wall 68 of the holder. The button 84 includes an inner stem portion 85, a proximal end portion 87, and an enlarged radial flange 86 between the stem portion and the proximal end portion. A spring 88 urges the button 84 outwardly relative to the cavity 82 so that the proximal end portion 87 of the button is exposed on the side exterior of the holder 80. A retaining collar 90 threadably secured to the side of the holder receives the proximal end portion 87 of the button therethrough and engages the flange 86 to captivate the button 84 within the cavity 82. Upon inward depression of the exposed proximal end portion 87 towards the side of the holder, the flange 86 is caused to be moved axially inward to compress the spring 88, as the stem portion 85 of the button engages the peg member 64, thereby urging the peg member 64 inwardly to the compressed position, as described above. In this manner, the peg member 64 is released from the recess 66 so that the housing 12 can be removed from the holder 80. Upon release of the inward force on the button, the spring 88 urges the proximal end portion 87 outward, until the flange 86 engages the collar 90, to thereby return the button to the normally relaxed position.

Figure 9A:
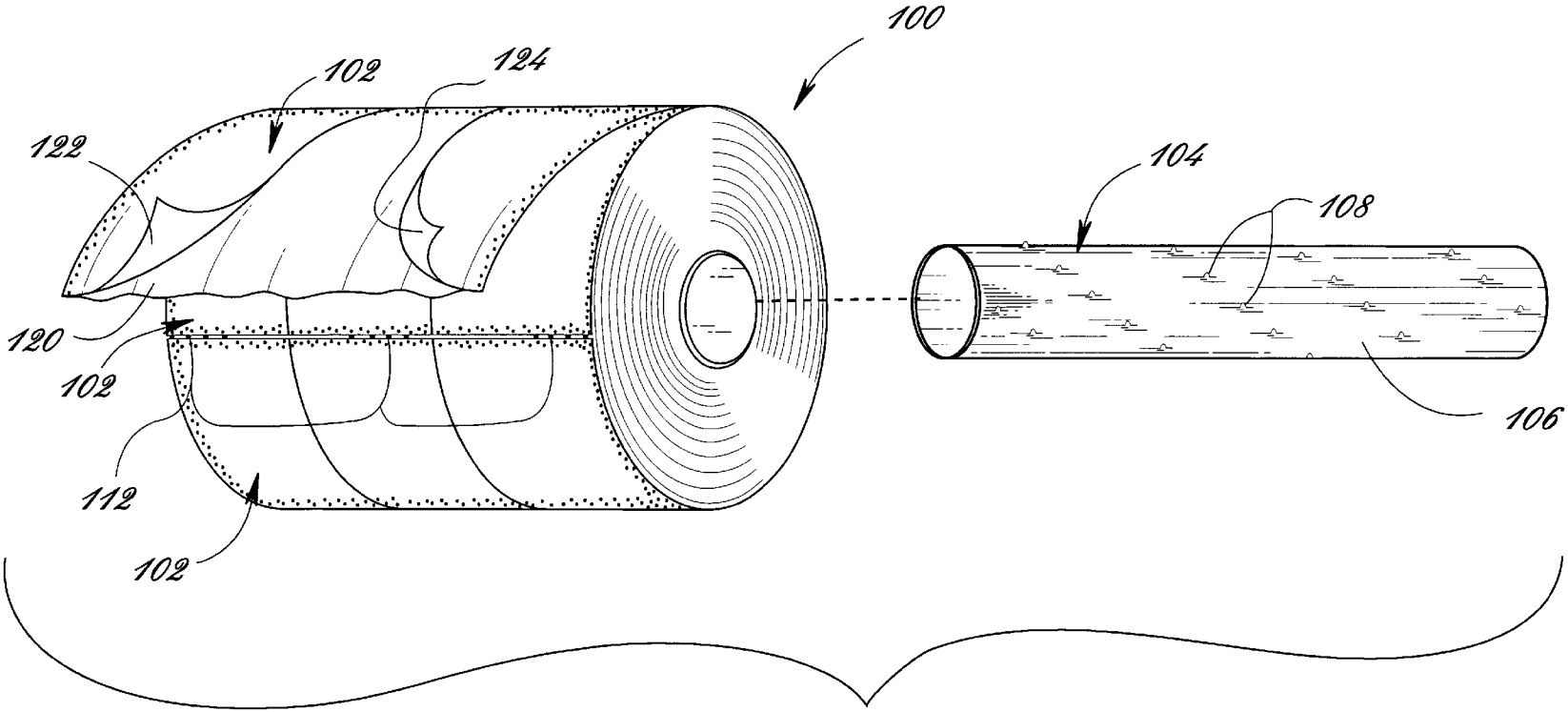
FIG. 9A is a partially exploded perspective view showing the roll of moistened toilet tissue and a hollow tubular core of the roll removed for purposes of illustration.

Referring to FIGS. 8 and 9A, the moistened roll of tissue 100 is shown to include the plurality of individual moistened tissue sheets 102 packaged on the roll and about a central tubular core 104. The tubular core 104 includes an outer cylindrical surface 106 which is provided with catch means 108, such as small bumps, for gripping the first sheet(s) 102 wrapped about the core 104. In a preferred embodiment, each of the individual tissue sheets 102 are secured to a next adjacent sheet at three perforated segments 112, as seen in FIG. 9, to permit ease of separation of the individual sheets 102 from the roll 100. Thus, each individual sheet 102 can be pulled from the roll 100, and outwardly through the access opening 36 of the housing 12, as shown in FIG. 8, and then, upon applying a slight tug, to compromise (i.e. break) the attachment at the perforated segments 112, the individual sheet is separated from the roll, as the next adjacent sheet remains in position for subsequent dispensing out through the access opening. In a preferred embodiment, the sheets 102 are folded, as seen in FIGS. 8 and 9, to include three panel portions, including a central panel 120, and opposite side panels 122, 124. Specifically, the side panels 122, 124 are folded in overlying relation to the central panel 120, when the sheets are contained on the roll 100. Upon removal of each individual sheet 102 from the roll 100, the side panels 122, 124 can be folded open to enlarge the overall size of the sheet. This enables larger sheets 102 of moistened tissue to be contained on a roll the size of a conventional roll of toilet paper, thereby providing greater economy of use. Specifically, the ability to enlarge the size of each sheet after detaching it from the roll, combined with the effectiveness of the moistened nature of the tissue, enables hygienic cleaning using less sheets than are normally used with conventional toilet tissue. This in effect reduces the impact on the environment, by reducing the amount of waste disposal during each use of the commode.

Figure 9B:
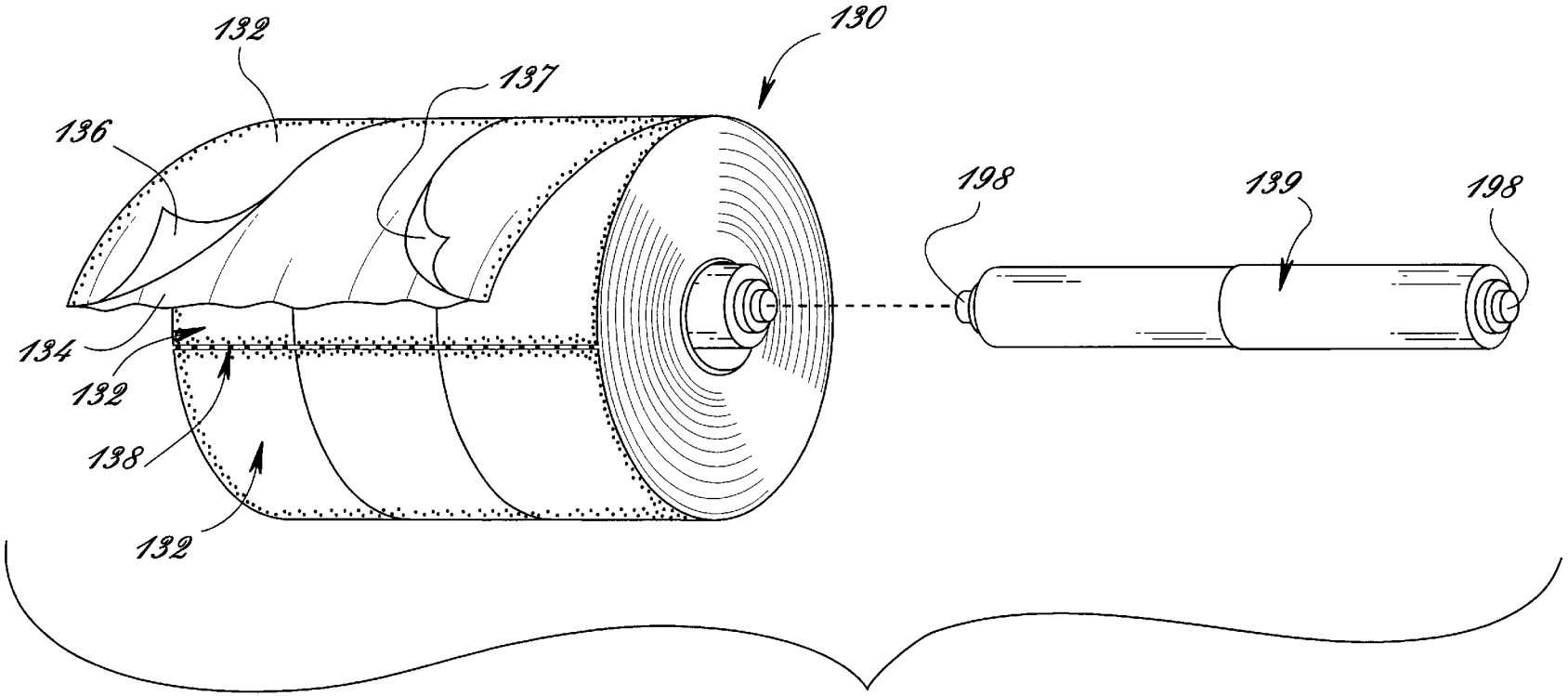
FIG. 9B is a partially exploded perspective view showing a roll of dry toilet tissue according to the present invention and a conventional spring loaded dowel for mounting the dry roll of tissue in the holder of the invention.

Referring to FIG. 9B, a dry roll of tissue is shown in accordance with a further embodiment of the present invention. Specifically, the dry roll of tissue 130 includes a plurality of sheets 132 contained in a roll about a central tubular core, similar to that of conventional toilet tissue. Unlike conventional toilet tissue, the sheets 132 of the present invention are folded in a manner similar to that described in connection with the moistened roll of tissue 100 shown in FIGS. 8 and 9A, and described above. Specifically, the sheets 132 of the dry roll of tissue 130 are folded to include three panel portions, including a central panel 134, and opposite side panels 136, 137. The side panels 136, 137 are folded in overlying relation to the central panel 134 when the sheets 132 are contained on the roll 130. Upon removal of each of the individual sheets 132 from the roll 130, the side panels 136, 137 can be folded open to enlarge the overall size of the sheet 132. Similar to the sheets 102 of the moistened tissue 100, as described above, by folding the sheets 132 of the dry tissue, larger sheets can be contained on a roll of the size of a conventional roll of toilet tissue, thereby providing greater economy of use. Once the tissues 132 are removed and separated along a perforated seam 138, they can be opened and enlarged prior to use. This reduces the number of sheets required for hygienic cleaning purposes and minimizes the impact on the environment by reducing the amount of waste disposable after each use. The dry roll of tissue 130 is rotatably supported on a conventional dowel 139, which may be of the spring loaded type to permit contraction of the length of the dowel 139 for insertion and removal within a holder. The dry roll of tissue 130 and spring loaded dowel 139 are particularly suited for use in connection with the embodiment of FIGS. 16 and 17 to be described more fully hereinafter. Alternatively, the dry roll 130 can be mounted in a conventional toilet tissue roll holder or the holder described above in connection with FIGS. 1–2, or the holder shown and described in connection with FIGS. 12–15, as set forth hereinafter.

It should be noted that both the sheets 102 of the pre-moistened tissue and the sheets 132 of the dry tissue may be manufactured specifically for use by both adults and babies. More particularly, both the moistened tissue and the dry tissue may be manufactured and marketed as different products, one for adults and another for babies. Moreover, the sheets 102 of the moistened tissue and the sheets 132 of the dry tissue may be manufactured as paper towels, hand wipes, wet towelettes, or napkins. As such, it is not the intent of the present invention to limit the manufacture and use of either the moistened tissue or dry tissue to a bathroom hygienic product.

Figure 11A:
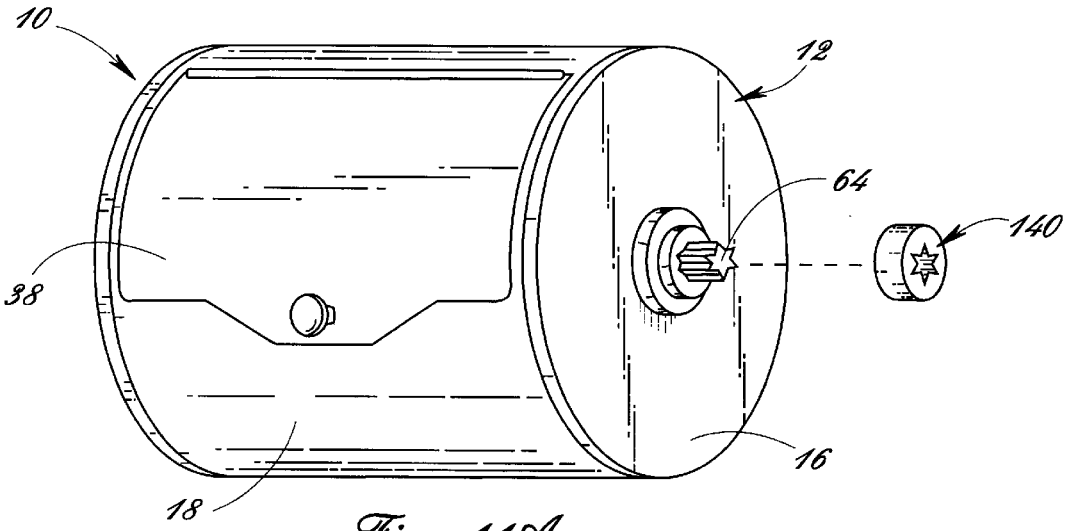
FIG. 11A is a front perspective view of the dispenser housing illustrating attachment of an adapter to a mounting peg of the housing, to facilitate mounting of the housing within a conventional toilet paper roll holder.
Figure 11B:
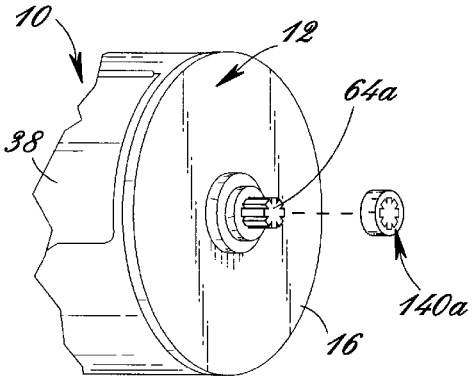
FIGS. 11B–11E each illustrate an isolated perspective view of an end of the housing to show alternative embodiments of the mounting peg and adapter which attaches to the mounting peg.
Figure 11C:
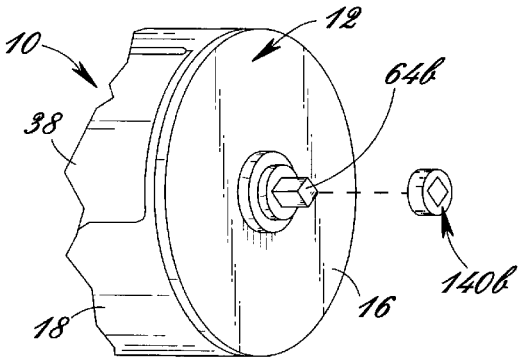
Figure 11D:
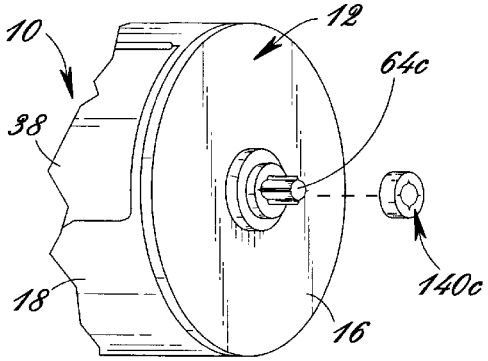
Figure 11E:
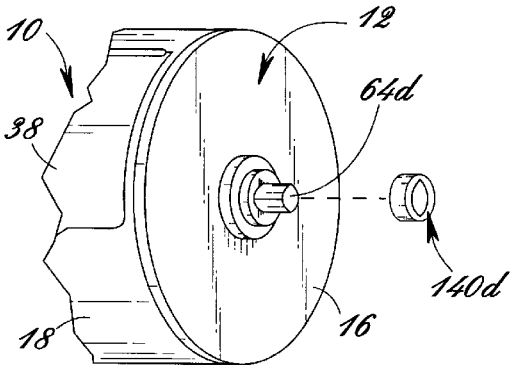
Figure 12:
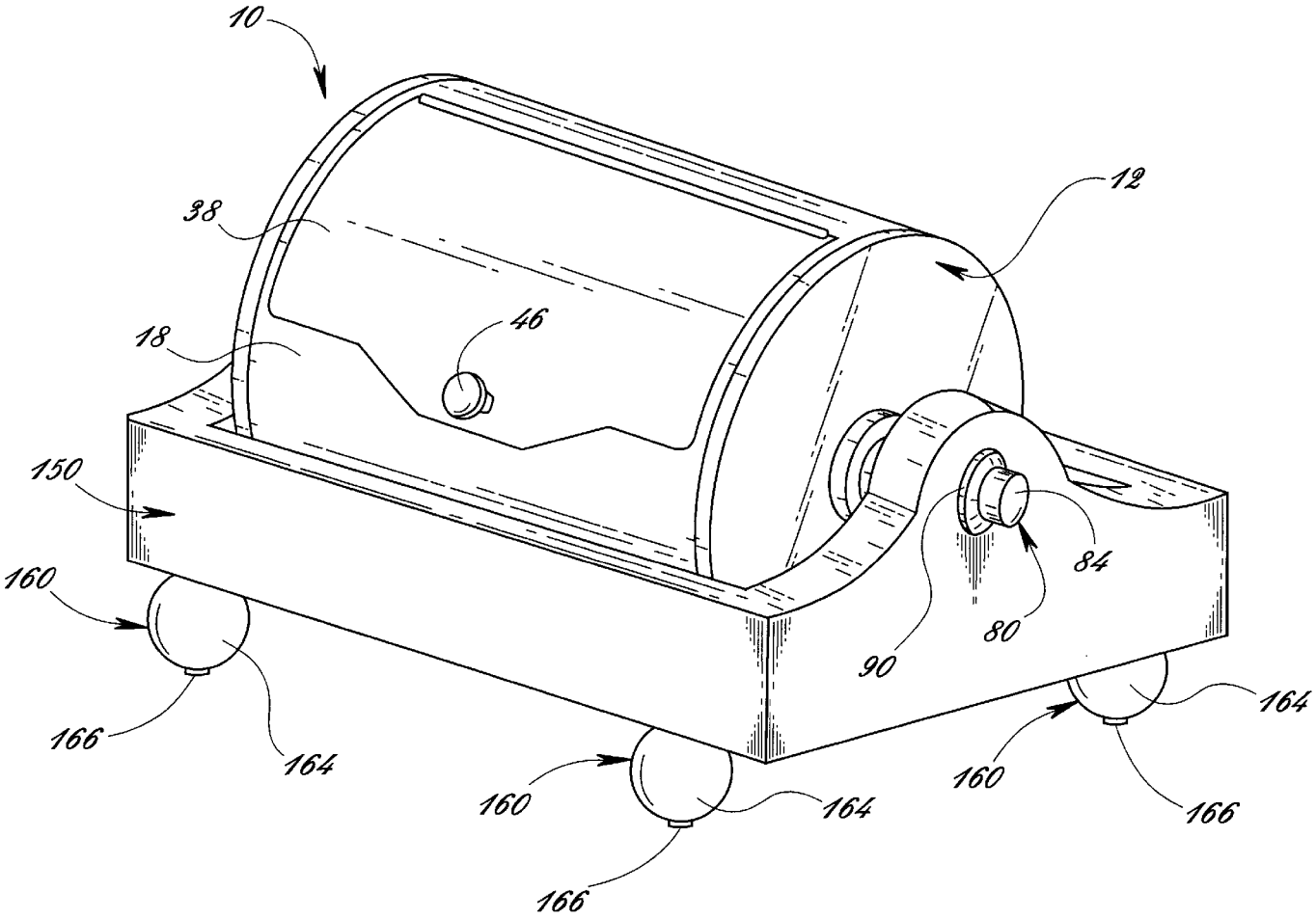
FIG. 12 is a front, top perspective view showing the dispenser housing mounted within a counter top holder in accordance with a further embodiment of the present invention.
Figure 13:
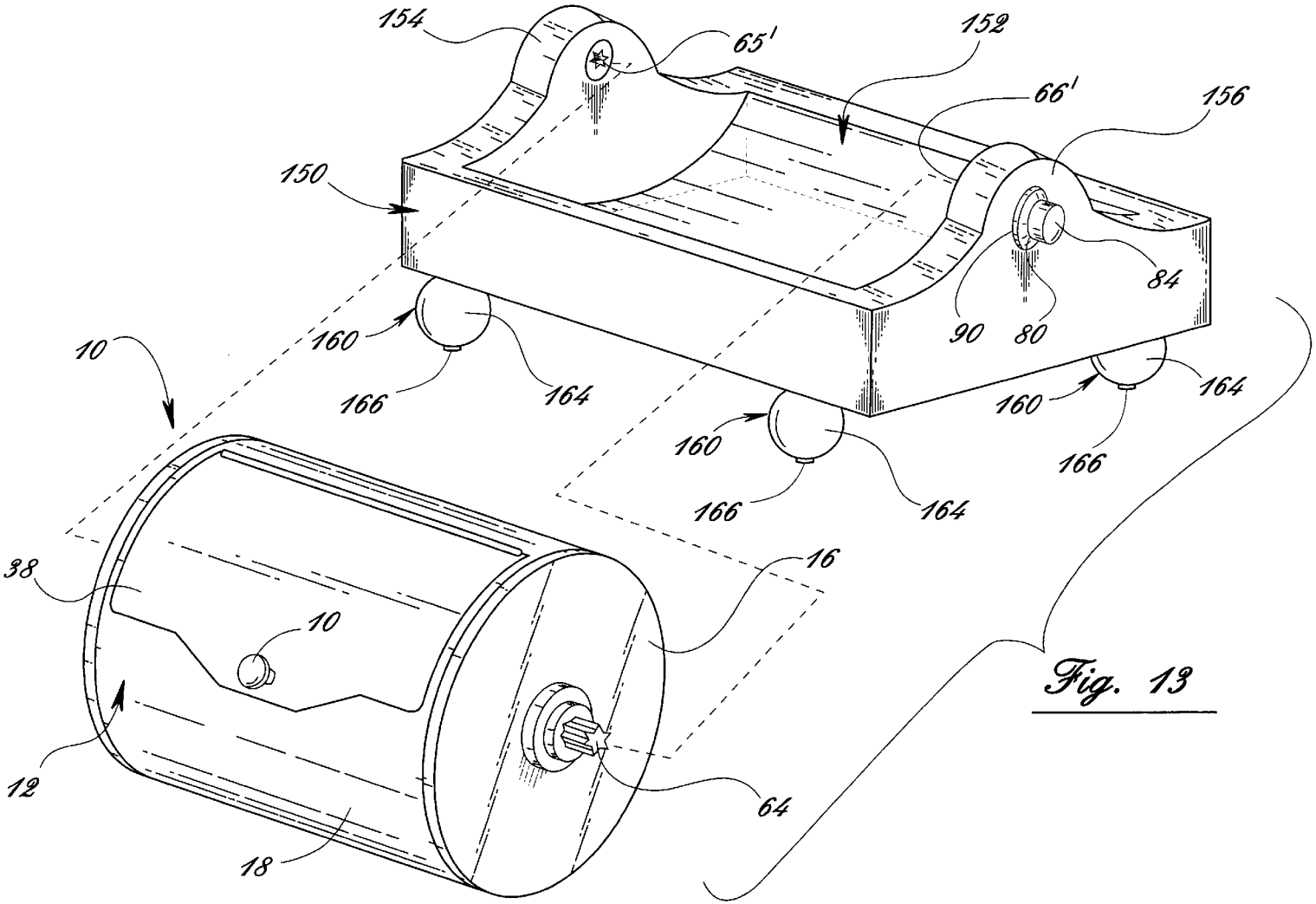
FIG. 13 is an exploded perspective view showing the dispenser housing separated from the counter top holder of FIG. 12.

Referring to FIG. 11A, an adapter 140 is provided for attachment to the opposite peg members 62, 64 to facilitate mounting of the housing 12 within a conventional toilet paper roll holder. Specifically, the adapter 140 fits to the peg members and covers the multi-angled keyed configuration to a provide a smooth, outer cylindrical peg surface which is readily adapted for receipt within a dowel peg recess of a conventional toilet paper roll holder. FIGS. 11B–11E show alternative multi-angle configurations of the peg members 64*a*–64*d* and adapters 14*a*–14*d* having congruently configured apertures for receipt and attachment to the respective peg members 64*a*–64*d*.

Figure 14:
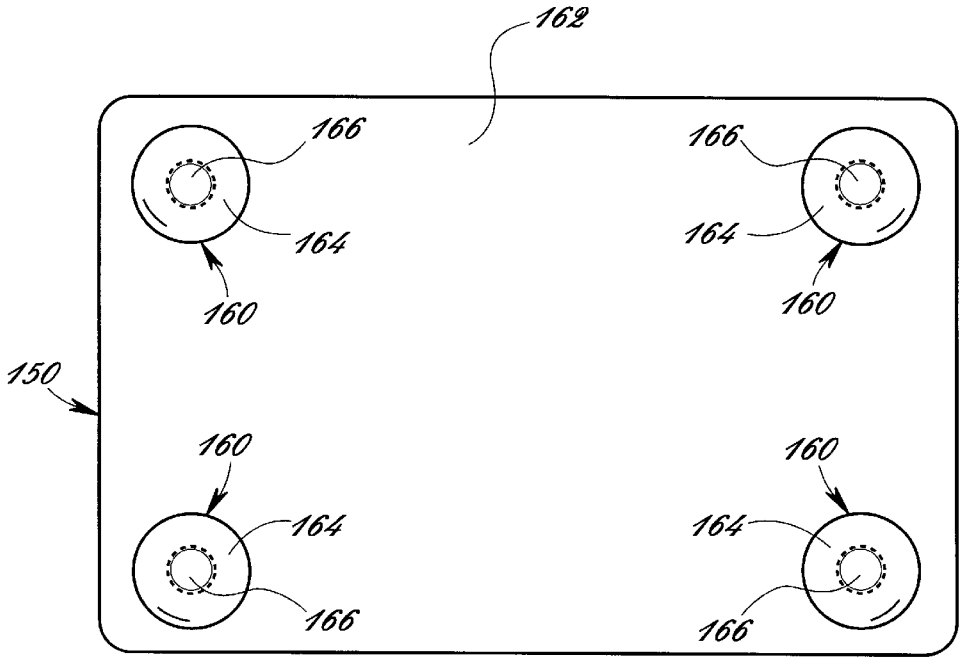
FIG. 14 is a bottom plan view of the counter top holder of FIG. 12.
Figure 15:
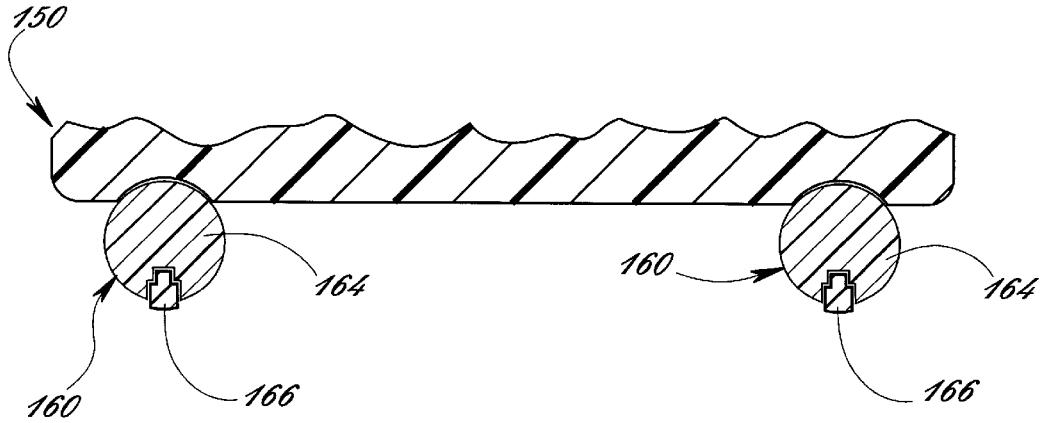
FIG. 15 is an isolated cross-sectional view taken along the plane of the line 15—15 of FIG. 14, illustrating grip members fitted to the round legs of the table top holder for supporting the dispenser on a surface in a manner which prevents sliding of the holder and scratching of the surface.

Referring to FIGS. 12–15, a counter top holder 150 is shown in accordance with a further embodiment of the present invention. Specifically, the counter top holder 150 includes cradle means 152 for receipt of the housing 12 of the dispenser device 10 therein, in the same general manner as described in connection with the holder 20 described above. Specifically, the peg members 62, 64 fit within congruently configured keyed recesses 65', 66' formed in opposite side walls 154, 156 of the cradle means 152 to removably support the housing 12 within the cradle means in a manner which prevents rotation of the housing when dispensing the individual tissue sheets 102 of tissue therefrom. Similar to the holder 20 described above, the counter top holder 150 may be provided with an ejection mechanism 80 to facilitate ease of removal of the housing 12 from the cradle means 152. Leg support means 160 may be provided on a bottom 162 of the counter top holder 150 to support and stabilize the counter top holder on a flat surface, such as on a vanity counter top or the tank top of a toilet. The leg support means 160 may be of a decorative nature, such as round balls 164 shown in the embodiment of FIGS. 12–15. In this particular embodiment, four round ball-shaped leg members 164 are positioned at the four corresponding corners on the bottom 162 of the holder 150, as best seen in FIG. 14. To further stabilize the counter top holder 150, and to prevent unwanted movement (i.e., sliding) of the counter top holder when dispensing the tissues therefrom, grip members 166 may be fitted to the bottom of each of the leg support members 164. Specifically, as seen in FIGS. 14 and 15, rubber grip inserts 166 are fitted within a socket or cavity 168 formed within the ball-shaped leg members 164. The rubber inserts 166 are specifically structured to engage the surface upon which the counter top holder 150 rests, in a manner which stabilizes the holder so that it does not slide when the tissues are dispensed from the housing. Further, the rubber inserts 166 on the bottom of the ball-shaped legs 164 help to prevent scratching of marble, glass, wood, or other counter top surfaces.

Figure 16:
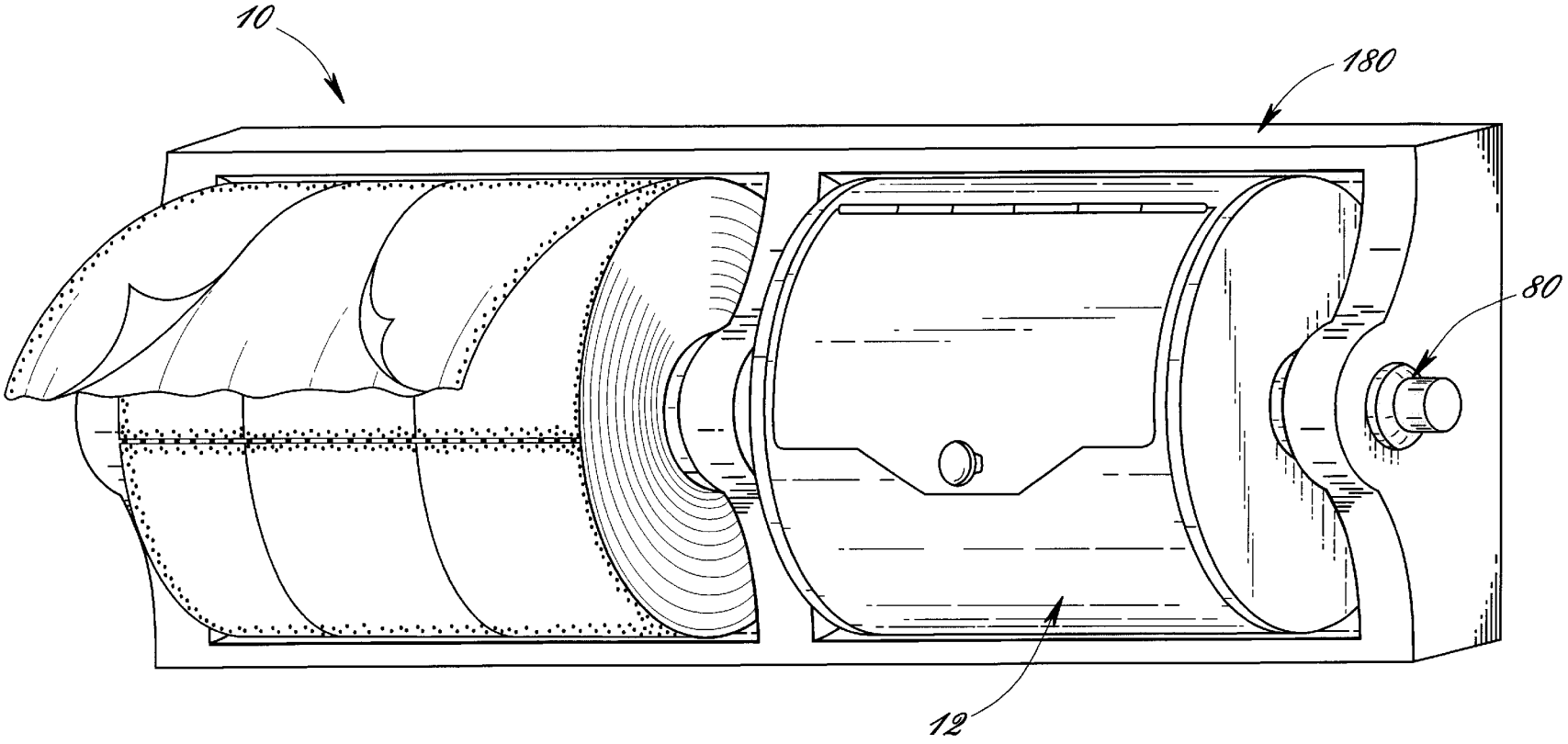
FIG. 16 is a front perspective view showing an alternative embodiment of the holder, wherein means are provided for accommodating both the moistened roll of tissue and housing in one receptacle and a dry roll of tissue in an adjacent receptacle.
Figure 17:
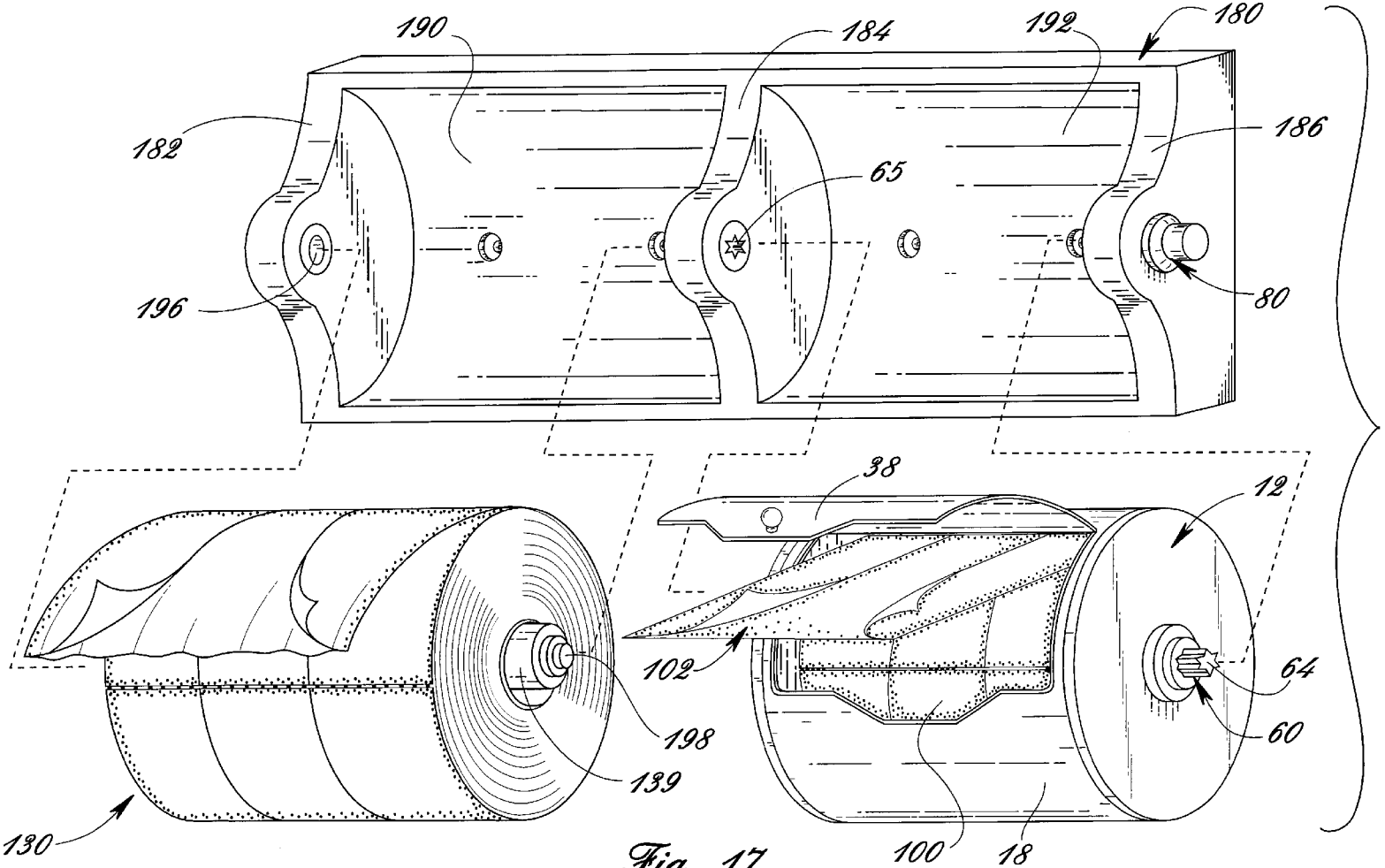
FIG. 17 is an exploded perspective view showing the holder of FIG. 16 and insertion of both the housing containing the moistened tissues and a roll of dry tissues in the respective, adjacently positioned receptacles of the holder.

Referring to FIGS. 16 and 17, an alternative embodiment of the holder is shown and is generally indicated as 180. The holder 180 is a dual roll holder which is specifically adapted to accommodate both the housing 12 containing the moistened roll of tissue 100 and the dry roll of tissue 130 described previously in connection with FIG. 9B. The holder 180 includes opposite end walls 182 and 186, and a central wall 184 positioned between the opposite end walls 182, 186 to define a pair of adjacently positioned receptacles 190, 192. The receptacle 190 is specifically adapted for receipt of the dry roll 130 therein, between the walls 182 and 184. More particularly, recesses 196 are provided in the opposing inner faces of the respective walls 182, 184 for receipt of pins 198 on opposite ends of the dowel 139. By compressing two halves of the dowel 139 inwardly, against an internal spring, the length of the dowel 139 is reduced to permit insertion and removal of the pins 198 on the opposite ends of the dowel within the respective recesses 196. In this manner, the roll of dry tissue 130 is rotatably supported and maintained within the receptacle 190 of the holder 180.

Figure 2:
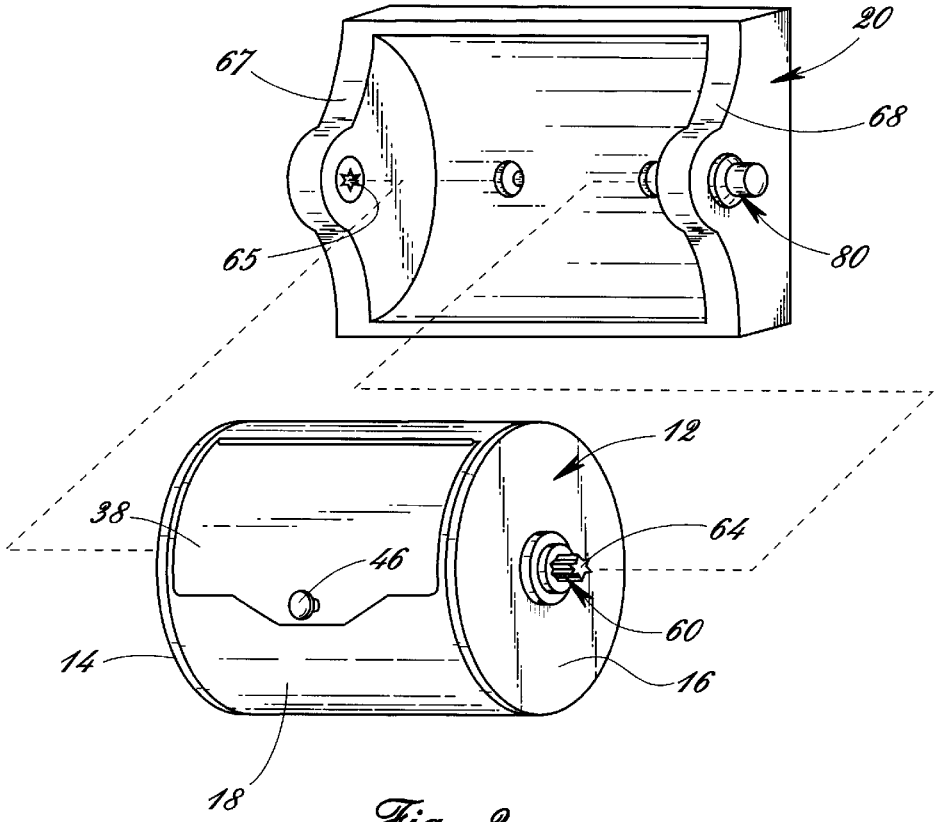
FIG. 2 is a partially exploded perspective view showing the dispenser housing and holder of the present invention, with the dispenser housing removed from the holder.

The receptacle 192 of the holder 180 is particularly adapted for receipt of the housing 12 therein, in the same manner as described in connection with the previous embodiments, and particularly that shown and described in connection with FIGS. 1–2 and 10.

While the instant invention has been shown and described in accordance with a practical and preferred embodiment thereof, it is recognized that departures from the instant disclosure are contemplated within the spirit of the invention and, therefore, the scope of the invention should not be limited except as defined within the following claims as interpreted under the doctrine of equivalents.

What is claimed is:

1. A device for dispensing sheets of moistened tissue from a roll comprising:

a housing including a cylindrical side wall, a first end wall, and an opposite second end wall, said cylindrical side wall and said first and second opposite end walls surrounding an interior chamber of said housing;

roll support means for rotatably supporting the roll of moistened tissue within said interior chamber in a manner which permits removal of the sheets from the roll;

an access opening in said cylindrical side wall, said access opening being sized and configured to permit passage of the sheets of moistened tissue therethrough;

a holder for removably supporting said housing in an operative position;

means for preventing rotation of said housing relative to said holder when removing the sheets of moistened tissue from the roll with said housing supported in said operative position;

attachment means for removably attaching said first end wall to said housing to facilitate replacement of the roll within said interior chamber;

a door hingedly fixed to said housing and being movable between an open position to reveal said access opening, thereby permitting dispensing of the individual sheets of moistened tissue from the roll and through said access opening, and a closed position defined by said door being positioned and disposed in covering relation to said access opening to thereby close said access opening;

first seal means for providing an air tight seal between said first end wall and said cylindrical wall of said housing when said first end wall is attached to said housing; and second seal means for providing an air tight seal between said door and said housing when said door is in said closed position.

2. The device as recited in claim 1 wherein said roll support means comprises a tubular dowel extending axially through said interior chamber, said tubular dowel being structured and disposed for axial passage through the roll for rotatably supporting the roll thereon.

3. The device as recited in claim 2 wherein said tubular dowel is integral with said second end wall of said housing.

4. The device as recited in claim 1 wherein said holder includes opposing first and second faces, said first and second faces being spaced apart a sufficient distance to permit receipt of said housing therebetween so that said first end wall is parallel with and spaced from said first face and said second end wall is parallel with and spaced from said second face.

5. The device as recited in claim 4 further comprising:

peg members extending axially outward from said first and second end walls of said housing; and recesses are provided in said first and second faces of said holder, said recesses being structured and disposed for removable receipt of said peg members therein to thereby removably support and hold said housing in said operative position.

6. The device as recited in claim 5 further comprising:

peg biasing means for allowing axial movement of at least one of said peg members between a normally, relaxed extended position and a retracted position defined by said at least one peg member being at least partially moved axially inward relative to said housing to facilitate removal and replacement of said housing between said opposing first and second faces of said holder.

7. The device as recited in claim 6 further comprising:

ejection means for releasing said housing from said operative position within said holder in order to remove said housing from said holder.

8. The device as recited in claim 7 wherein said ejection means includes a depressible button exteriorly accessible on said housing, said button being operable to move said at least one peg member axially inward to said retracted position in order to remove said at least one peg member from said recess of said holder, thereby facilitating removal of said housing from said holder.

9. The device as recited in claim 8 wherein said means for preventing rotation of said housing comprises:

a multi-sided configuration provided on each of said peg members; and a corresponding multi-sided configuration provided in said recesses for congruent receipt of said multi-sided configuration of said peg members therein.

10. The device as recited in claim 1 wherein said holder further comprises means for removably and rotatably supporting a roll of dry tissue.

11. The device as recited in claim 10 wherein said holder comprises a first receptacle for removably supporting said housing in said operative position and a second receptacle for removably supporting said roll of dry tissue.

12. A device for dispensing sheets of moistened tissue from a first roll and sheets of dry tissue from a second roll, said device comprising:

a housing including a cylindrical side wall, a first end wall, and an opposite second end wall, said cylindrical side wall and said first and second opposite end walls surrounding an interior chamber of said housing;

roll support means for rotatably supporting the first roll of moistened tissue within said interior chamber in a manner which permits removal of the sheets from the roll;

an access opening in said cylindrical side wall, said access opening being sized and configured to permit passage of the sheets of moistened tissue therethrough;

a holder for removably supporting said housing in an operative position and said holder being further adapted for rotatably supporting the second roll of dry tissue in an operative position for dispensing the sheets of dry tissue therefrom;

means for preventing rotation of said housing relative to said holder when removing the sheets of moistened tissue from the first roll with said housing supported in said operative position;

attachment means for removably attaching said first end wall to said housing to facilitate replacement of the first roll within said interior chamber;

a door hingedly fixed to said housing and being movable between an open position to reveal said access opening, thereby permitting dispensing of the individual sheets of moistened tissue from the first roll and through said access opening, and a closed position defined by said door being positioned and disposed in covering relation to said access opening to thereby close said access opening;

first seal means for providing an air tight seal between said first end wall and said cylindrical wall of said housing when said first end wall is attached to said housing; and second seal means for providing an air tight seal between said door and said housing when said door is in said closed position.

13. The device as recited in claim 12 wherein said roll support means comprises a tubular dowel extending axially through said interior chamber, said tubular dowel being structured and disposed for axial passage through the first roll for rotatably supporting the first roll thereon.

14. The device as recited in claim 13 wherein said tubular dowel is integral with said second end wall of said housing.

15. The device as recited in claim 14 further comprising:

ejection means for releasing said housing from said operative position within said holder in order to remove said housing from said holder.

16. A package of paper comprising:

a hollow tubular core;

a plurality of sheets of paper wound about said tubular core in the form of a roll;

perforation means for releasably attaching said plurality of sheets to one another along a length and said perforation means being adapted for permitting individual detachment and separation of said plurality of sheets from said roll;

each of said plurality of sheets including a central panel and opposite side panels having longitudinal edges, said side panels being folded in overlying relation to a top side of said central panel so that said longitudinal edges are disposed in opposing, spaced relation to one another on the top side of said central panel to define a recessed area therebetween, and said recessed area and said respective longitudinal edges being exposed on an outside central area of the roll to allow said side panels to be conveniently and easily grasped along said longitudinal edges when separating said sheet from said roll, and said side panels being adapted to be opened to be coplanar with said central panel to enlarge said sheet when said sheet is separated from said roll.

17. The package as recited in claim 16 wherein said plurality of sheets are pre-moistened.

18. The package as recited in claim 16 wherein said plurality of sheets are dry.

* * * * *